US011826599B2

(12) United States Patent
Sokolovas et al.

(10) Patent No.: US 11,826,599 B2
(45) Date of Patent: Nov. 28, 2023

(54) SYSTEM AND METHOD FOR VARYING LOAD IN PHYSICAL EXERCISE

(71) Applicants: Genadijus Sokolovas, Colorado Springs, CO (US); David W. Wilhide, Colorado Springs, CO (US); Birute Sokolovas, Colorado Springs, CO (US)

(72) Inventors: Genadijus Sokolovas, Colorado Springs, CO (US); David W. Wilhide, Colorado Springs, CO (US); Birute Sokolovas, Colorado Springs, CO (US)

( * ) Notice: Subject to any disclaimer, the term of this patent is extended or adjusted under 35 U.S.C. 154(b) by 11 days.

(21) Appl. No.: 16/805,622

(22) Filed: Feb. 28, 2020

(65) Prior Publication Data

US 2021/0268325 A1 Sep. 2, 2021

(51) Int. Cl.

| | |
|---|---|
| ***A63B 21/005*** | (2006.01) |
| ***A63B 24/00*** | (2006.01) |
| ***A63B 21/00*** | (2006.01) |

(52) U.S. Cl.

CPC .... *A63B 21/0056* (2013.01); *A63B 21/00069* (2013.01); *A63B 24/0087* (2013.01); *A63B 2024/0093* (2013.01)

(58) Field of Classification Search

None

See application file for complete search history.

(56) References Cited

U.S. PATENT DOCUMENTS

| | | | | |
|---|---|---|---|---|
| 4,358,105 | A * | 11/1982 | Sweeney, Jr. | A63B 24/00 482/5 |
| 5,816,372 | A * | 10/1998 | Carlson | F16D 57/002 188/267.2 |
| 6,147,674 | A * | 11/2000 | Rosenberg | G05G 9/047 345/157 |
| 7,682,287 | B1 * | 3/2010 | Hsieh | A63B 21/153 482/4 |
| 2007/0298941 | A1 * | 12/2007 | Egger | A63B 21/072 482/108 |
| 2010/0151994 | A1 * | 6/2010 | Yeh | A63B 22/00 482/4 |
| 2010/0298097 | A1 * | 11/2010 | Preumont | A63B 21/0056 482/44 |
| 2011/0237400 | A1 * | 9/2011 | King | A63B 21/4017 482/8 |
| 2013/0190143 | A1 * | 7/2013 | Greenhill | A63B 21/0058 482/104 |
| 2014/0038777 | A1 * | 2/2014 | Bird | G16Z 99/00 482/5 |
| 2014/0213414 | A1 * | 7/2014 | Balandis | G10L 15/22 482/5 |

(Continued)

FOREIGN PATENT DOCUMENTS

| | | | | |
|---|---|---|---|---|
| CN | 103200909 A | * | 7/2013 | A61F 5/0102 |
| KR | 20180109750 | * | 10/2018 | A61H 23/00 |

(Continued)

*Primary Examiner* — Shila Jalalzadeh Abyaneh

(74) *Attorney, Agent, or Firm* — Shun Yao; Yao Legal Services, Inc.

(57) ABSTRACT

Embodiments disclosed herein provide an exercise system that facilitates a varying load. During operation, the system produces a load-control pattern using a control module, and varies a load using a load-varying mechanism based on the load-control pattern, thereby facilitating varying-load during exercise for effective muscle stimulation.

17 Claims, 7 Drawing Sheets

(56) References Cited

U.S. PATENT DOCUMENTS

| | | | | |
|---|---|---|---|---|
| 2018/0214729 | A1* | 8/2018 | Rubin | A63B 21/0058 |
| 2021/0354002 | A1* | 11/2021 | Schaefer | A63B 71/0622 |
| 2021/0361994 | A1* | 11/2021 | Nørgaard | H02P 7/29 |
| 2022/0136576 | A1* | 5/2022 | Farris | A61H 1/0244 601/5 |

FOREIGN PATENT DOCUMENTS

| | | | | |
|---|---|---|---|---|
| KR | 20180109750 | A * | 10/2018 | A61H 23/00 |
| WO | WO-2007032664 | A1 * | 3/2007 | A61H 23/00 |

* cited by examiner

SYSTEM AND METHOD FOR VARYING LOAD IN PHYSICAL EXERCISE

FIELD

This disclosure is generally related to a system and method for facilitating effective exercise.

BACKGROUND

Studies have shown that when vibration is added to a conventional exercise, more motor units in the muscle are stimulated and engaged. As a result, the stimulation is more effective and the subsequent muscle development can occur faster. For example, a vibration-assisted exercise system is disclosed in U.S. Pat. No. 7,238,143, entitled "BODY VIBRATION GENERATOR HAVING ATTACHMENTS FOR EXERCISES TO TARGET BODY REGIONS," by inventors Genadijus Sokolovos, Nikiforas Sokolovas, and Birute Sokolova, which is incorporated by reference herein.

Adding mechanical vibration to an exercise system, however, is not always feasible. Various existing exercise machines may have space limitations. In addition, certain types of exercise machines may use a loading mechanism that can be incompatible with adding physical vibration.

SUMMARY

One embodiment of the present invention provides an exercise system that facilitates a varying load. During operation, the system produces a load-control pattern using a control module, and varies a load using a load-varying mechanism based on the load-control pattern, thereby facilitating varying-load during exercise for effective muscle stimulation.

In a variation on this embodiment, the load-control pattern indicates one or more parameters, such as: an amplitude range for the load, a frequency range for varying the load, a period duration for varying the load, a number of periods for load variation, a randomized load, and a randomized frequency for varying the load.

In a variation on this embodiment, the system receives a user input to select a pre-configured load-varying program or to define a custom load-varying program.

In a variation on this embodiment, the load-varying mechanism includes an electrical generator coupled to a circuit. Furthermore, the circuit includes a circuit-control module.

In a further variation, the circuit-control module can vary a resistive load of the circuit using pulse width modulation based on a control signal.

In a variation on this embodiment, the load-varying mechanism includes an electro-magnetic braking mechanism.

In a further variation, the electro-magnetic braking mechanism applies a braking force based on the load-control pattern.

In a further variation, the system includes a rotor. In addition, the electro-magnetic braking mechanism applies a braking force on the rotor.

In a variation on this embodiment, the system includes a weight coupled to the load-varying mechanism.

In a variation on this embodiment, the load-varying mechanism includes a mechanical braking mechanism.

In a further variation, the mechanical braking mechanism includes a rotor plate, a plurality of adjustable magnets positioned on the rotor plate, and a fixed magnet positioned near the rotor plate. The height of a respective adjustable magnet can be adjusted, which facilitates variation of distance between the adjustable magnet and the fixed magnet, thereby allowing a resistance force between the rotor plate and the fixed magnet to be varied when the rotor plate rotates.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein. Furthermore, embodiments of the present invention are not limited to the examples described herein, and can be used with any resistance based training equipment.

Overview

Embodiments of the present invention solve the problem of improving the efficacy in various exercise systems by varying the load of these exercise systems. By varying the load of an exercise, the present inventive system can achieve a similar result as an exercise system that applies mechanical vibration. Furthermore, the present inventive system can be used with a wide variety of exercise mechanisms that are incompatible with adding mechanical vibration. As a result, the improved efficacy associated with vibration or varying load can be attained for exercises specific to a large number of sports and/or exercises associated with any resistance based training equipment.

Figure 1:
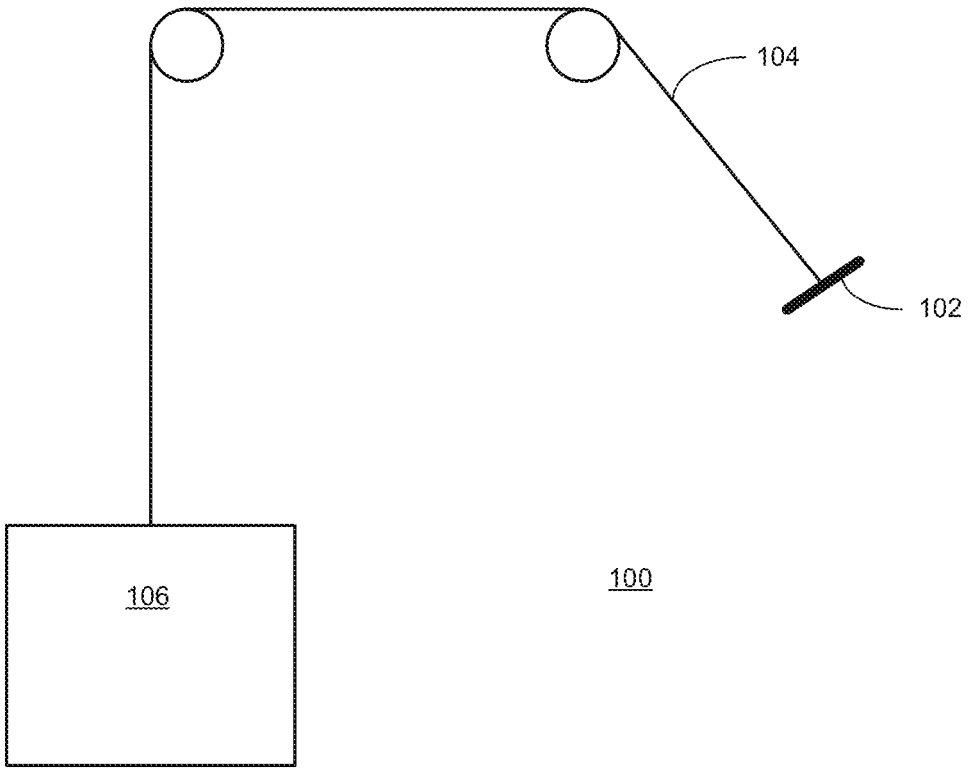
FIG. 1 presents a high-level block diagram illustrating an exemplary exercise system that facilitates a varying load, in accordance with one embodiment of the present invention.

FIG. 1 presents a high-level block diagram illustrating an exemplary exercise system that facilitates a varying load, in accordance with one embodiment of the present invention. In this example, exercise system 100 includes load-varying module 106, cable 104, and handle 102. When a user is using system 100, he can pull on handle 102, which is coupled to load-varying module 106 via cable 104. Load-varying module 106 can be configured to apply a load, which can vary rapidly. As a result, the resistance experienced by the user can also vary rapidly over time. Hence, the efficacy of the exercise can be improved, because more motor units in the user's muscles are engaged to counter-act the effect of the varying load. Note that the term "rapidly" is used here to indicate a range of frequency of the load variation with respect to the cycle of the user's typical exercise (for example, the amount of time it takes for the user to complete one movement cycle, e.g., a pulling motion or a lifting motion). Usually, the frequency of the load variation can range from a few hertz to tens or even hundreds of hertz.

Note that the example illustrated in FIG. 1 is only one of many possible configurations of the load-varying mechanism. In addition to a cable-based pull-action system, the load-varying mechanism can be used in other exercise systems, such as stationary bikes, rowing machines, and various strength or cardiovascular training systems.

Figure 2A:
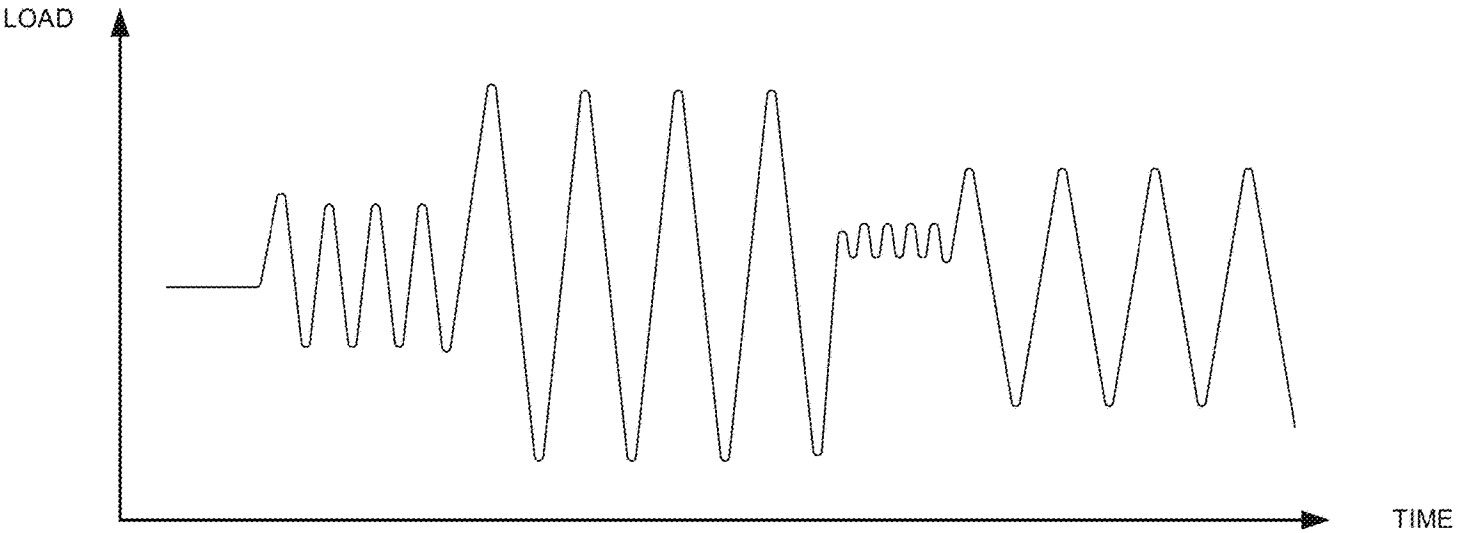
FIG. 2A illustrates an exemplary configuration for the varying load, in accordance with one embodiment of the present invention.

In general, load-varying module 106 can be configured to vary the load in terms of both amplitude and frequency. FIG. 2A illustrates an exemplary configuration for the varying load, in accordance with one embodiment of the present invention. This example shows how the load's amplitude can vary over time. In general, the load-varying module can be configured or programmed to change the amplitude of the load as well as the frequency of the variation. In addition, the amplitude change and frequency change can be programmed or randomized. In one embodiment, the load-varying module can be configured to vary the load amplitude within a predetermined range (e.g., 0.2-1 Kg). Note that the load variation can be a varying range superimposed on a base load. For example, the total load can be $X+A\cdot\mathrm{Cos}(\omega t)$ where X is the base load, A is the load-variation range, and w denotes the load-variation frequency. In addition, the load-variation frequency can also be configured (e.g., 3-20 Hz). In a further embodiment, the load-variation pattern (i.e., the duration of an amplitude-frequency combination, and a combination of multiple such durations) can also be pre-programmed, or randomized.

Figure 2B:
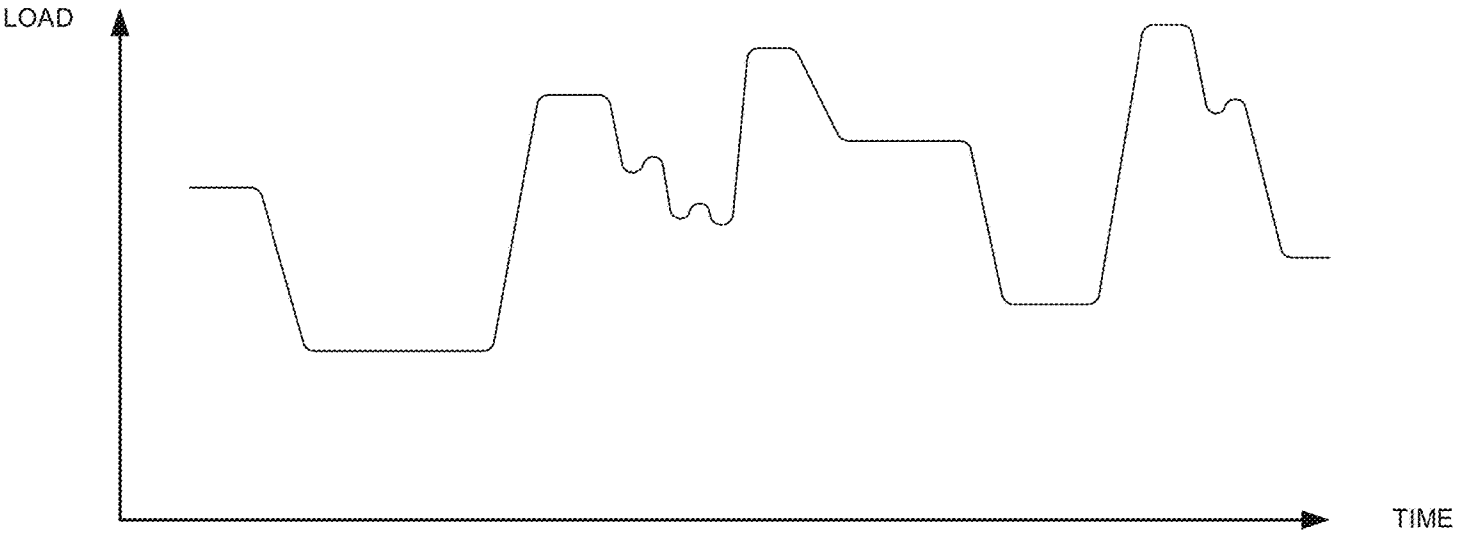
FIG. 2B illustrates another exemplary load-variation configuration, in accordance with one embodiment of the present invention.

FIG. 2B illustrates another exemplary load-variation configuration, in accordance with one embodiment of the present invention. In this example, the load amplitude is varied less frequently in comparison with the example in FIG. 2A. Specifically, the load amplitude can be changed to a given value and maintained at that value for a period of time, before it is changed to another value. The load amplitude can be changed based on a predetermined pattern, or based on a random process, optionally within limits set by a user.

Figure 3A:
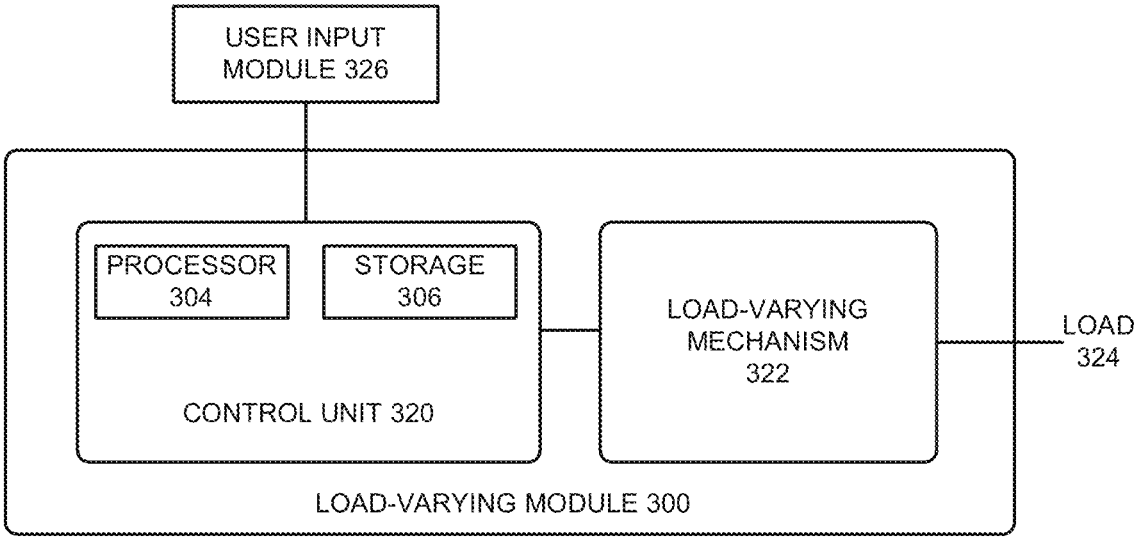
FIG. 3A illustrates an exemplary block diagram of a load-varying module, in accordance with an embodiment of the present invention.

In general, a load-varying exercise system can include a load-varying module that facilitates the load variation describe above. FIG. 3A illustrates an exemplary block diagram of a load-varying module, in accordance with an embodiment of the present invention. In this example, a load-varying module 300 can be part of an exercise system, and can include a control unit 320 and a load-varying mechanism 322. Control unit 320 can be responsible of generating the proper control signal to control load-varying mechanism 322. Based on the control signal, load-varying mechanism 322 can vary a load 324 accordingly. Note that load-varying mechanism 322 can vary load 324 mechanically, electrically, or electro-mechanically.

In one embodiment, control unit 320 can include a processor 304 and storage device 306, which can store the instructions which when executed by processor 304 cause the processor 304 to perform a method that facilitates generation of the control signal for load-varying mechanism 322. In addition, control unit 320 can be coupled to a user input module 326, which allows a user to select a pre-configured load-variation program or compose his own load-variation program. In one embodiment, user input module 326 can include a switch that allows a user to select between a pre-configured program and a user-defined program. In a further embodiment, user input module 326 can include a display and an input device (e.g., a touch screen). In a further embodiment, user input module 326 can include a communication module (such as a WiFi or Bluetooth module) that allows the system to communicate with a user device (such as an application running on a mobile device). The user can use the user device to program load-varying module 300.

Note that control unit 320 can allow a user to program or select the amplitude, frequency, and periods for varying the load. For example, a user can select a program that has two alternating load-variation periods, wherein during the first period the load varies between 20 and 25 kg, with a frequency range of 3-20 Hz; and wherein during the second period the load varies between 30-35 kg, with a frequency range of 2-8 Hz. The user can also define a customized program by specifying the load range, frequency range, period duration, and number of periods. In some embodiments, the program can be based on a random load and frequency.

Various methods can be used to implement the load-varying mechanism. The creation of a load can be based on a generator, electromagnetic brake, or mechanical brake. Other types of braking systems can also be used. These braking mechanisms can be controlled by an analog circuit, a digital circuit, or a combination thereof. An analog circuit can be used to adjust the load in a braking mechanism proportional to an input signal, for example by linearly varying the current through the field windings of an AC generator. The analog control circuit could be driven by a user interface with options for various parameters such as frequencies, load profiles, repetitions, etc.

Load control of various types of braking systems can also be carried out using digital pulse width modulation (PWM). A digital PWM load control system can involve turning the load fully on or fully off for varying durations at a sufficiently high frequency, so that the user does not perceive the pulse modulation. For example, if the user desires a load that is 90% of the maximum load, then the PWM circuit can generate a signal that is on for 90% of the pulse period and off for 10% of the pulse period (i.e., has a duty cycle of 90%). If the pulse is generated with a sufficiently high frequency, then the user would not perceive the pulsation (but can still experience the 90% load). This can be a generally lower-cost method for simulating an analog output using a digital processor. As an example, in the case of the varying-load vibration device where the user might want a load that is varying between 70% of maximum and 30% of maximum at a frequency of 10 hz, the PWM circuit can generate a pulse train with a frequency of 1 kHz and a duty cycle of 70% for 0.1 seconds, followed by a duty cycle of 30% for 0.1 seconds. This would create a load with a square wave profile. More complicated profiles could be generated by different PWM profiles.

Shown below is an oscilloscope output showing a digital PWM signal (lower trace) and the analog signal produced by filtering (upper trace). The PWM signal is a fixed frequency but the duty cycle is varied. The PWM frequency selected is high relative to the frequency content of the output so that filtering will produce a smooth signal.

Figure 3B:
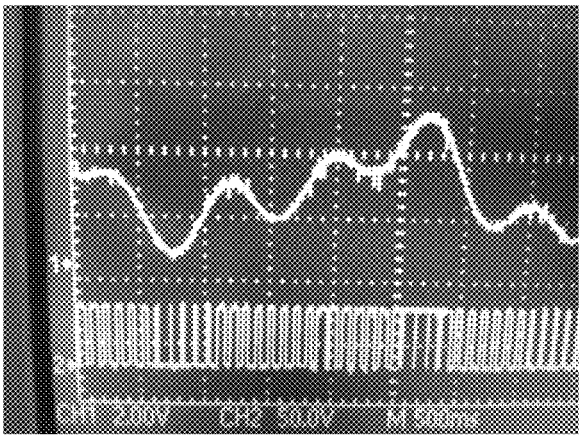
FIG. 3B illustrates an exemplary pulse width modulation signal trace, in accordance with an embodiment of the present invention.

FIG. 3B presents an exemplary oscilloscope output showing a digital PWM signal (lower trace) and the analog signal produced by filtering the digital PWM signal (upper trace). The PWM signal has a fixed frequency and a varied duty cycle. The PWM frequency selected is high relative to the frequency at which the duty cycle is varied, so that a low-pass filter can produce a smooth signal for varying the load.

In some embodiments, an electric generator coupled with a variable electrical load can be used to facilitate the load-varying mechanism. For example, a 12-pole brushless permanent-magnet motor running as a generator with a PWM circuit to control the load can be used as a load-varying system. The 12-pole motor can provide a relatively smooth feel for the user. In general, a 12-pole motor can be much smoother than a 2-pole motor.

Note that various methods can be used to create the load, such as systems employing electromagnetic brakes, generators, mechanical brake with electrical actuation, etc. Furthermore, there can be various ways to control these loads, e.g., analog circuit and digital PWM circuit.

Figure 4:
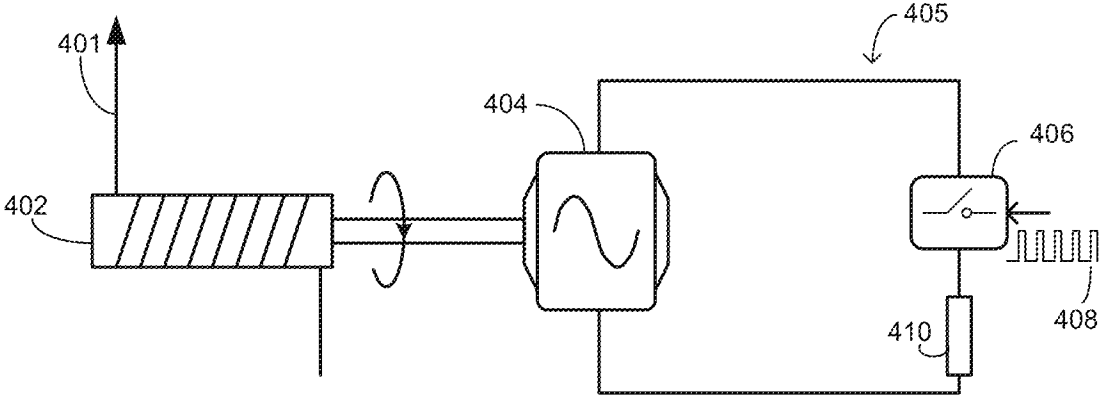
FIG. 4 illustrates an exemplary load-varying mechanism using an electric generator, in accordance with an embodiment of the present invention.

FIG. 4 illustrates an exemplary load-varying mechanism using an electric generator, in accordance with an embodiment of the present invention. In this example, a cable 401 is wound around a shaft 402, which is mechanically coupled to an electric generator 404. Electric generator 404 is part of a circuit 405 that can include a circuit-control module 406 and a resistive load 410.

During operation, a user's physical exercise can result in a linear motion of cable 401, which causes shaft 402 to rotate. In turn, shaft 402 can drive electric generator 404. As a result, a voltage is generated across circuit 405. In one embodiment, circuit-control module 406 can include an on/off switch that is controlled by a control signal 408. This on/off switch can open and close circuit 405 based on control signal 408. When the on/off switch in circuit-control module 406 opens circuit 405, no current can flow through circuit 405. As a result, only a small amount of mechanical resistance (which is caused by the interaction between the permanent magnets and coil in generator 404) is applied to shaft 402. When the on/off switch closes the circuit, a current flows through resistive load 410, which consumes power and generates heat. Correspondingly, a non-negligible, greater amount of mechanical resistance can be created by generator 404 and applied to shaft 402. Note that the on/off switch in circuit-control module 406 is for illustration purposes. In practice, the on/off switch can be implemented using a semiconductor device (for example, a device based on metal-oxide-semiconductor field-effect transistor (MOSFET) or insulated-gate bipolar transistor (IBGT)) and produce a PWM signal. Note that dynamic or active braking, where current is fed back into the windings of the motor, may be used depending on the load circuit inductance and PWM frequency.

In one embodiment, control signal 408 can be a high-frequency (for example, on the order of tens or hundreds of kilohertz) digital (or analog) signal. The duty cycle of control signal 408, which determines the portion of a full cycle duration during which circuit 405 is closed, can be used to control the amount of resistive load applied to circuit 405. For example, if the duty cycle of control signal 408 is 50%, on average, the amount of resistive load applied to circuit 405 is approximately 50% of resistive load 410. Therefore, by varying the duty cycle of control signal 408, one can vary the mechanical resistance applied to shaft 402. Note that the frequency of control signal 408 can be chosen to be sufficiently high, such that the user would not perceive the on/off switching of circuit 405.

To facilitate the actual desired physical load variation in terms of amplitude and frequency, as those illustrated in FIGS. 2A and 2B, in one embodiment, the desired physical load can be used as an input to compute the duty cycle of control signal 408.

The exemplary circuit illustrated in FIG. 4 is one of many ways to implement a varying resistive load in circuit 405. Other components and devices can also be used to achieve a similar effect. For example, a digital potentiometer, the resistance of which can be controlled by an external control signal, can be used to implement a variable resistive load. Furthermore, although the example in FIG. 4 shows a generator loading mechanism with a PWM load control, the generator loading mechanism could also be used with a linear load control. In other words, the loading mechanism and load control methods can be implemented separately.

Figure 5A:
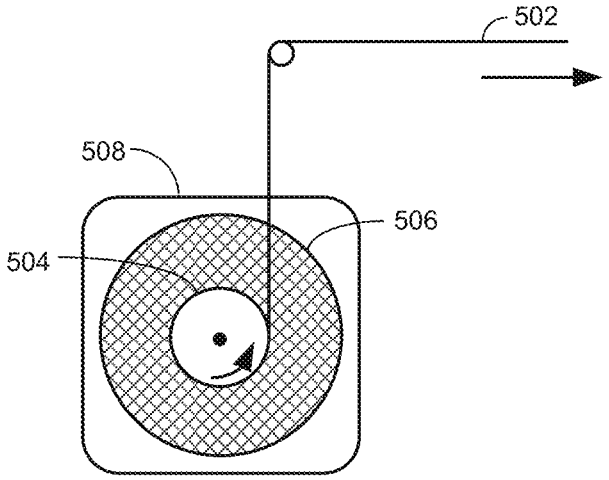
FIG. 5A illustrates a load-varying mechanism using an electro-magnetic brake, in accordance with an embodiment of the present invention.

In some embodiments, an electro-magnetic braking system can be used to facilitate load variation. FIG. 5A illustrates a load-varying mechanism using an electro-magnetic brake, in accordance with an embodiment of the present invention. In this example, a cable 502 is wound around a shaft 504, which is coupled to a rotor 506. During exercise, a user can pull on cable 502, which can cause shaft 504 to rotate. As a result, rotor 506 also rotates. In one embodiment, rotor 506 can be housed in an electro-magnetic braking system 508, which can apply a braking force to rotor 506 based on an input electric signal (e.g., a load-varying control signal). As a result, when a user pulls on cable 502, the physical resistance (i.e., the load) can be varied based on the control signal.

Note that various types of electro-mechanical braking systems can be used here. For example, electro-magnetic braking system 508 can be a friction-plate based brake, wherein a brake pad and an electro-magnetically actuated clutch can be used to slow down the motion of rotor 506, thereby controlling the resistance against the user's pulling motion. In a further embodiment, braking system 508 can be a particle based system, wherein magnetic particles can fill a cavity that houses rotor 506. When a magnetic flux is present (which can be proportional to the electricity supplied to the system), the magnetic particles tend to bind with each other, thereby creating a viscous environment for rotor 506. The viscosity of the binding particles is related to the strength of the magnetic flux, which in turn can be controlled by the load-varying control signal.

Other types of electro-magnetic brakes, such as hysteresis power brakes, can also be used.

Figure 5B:
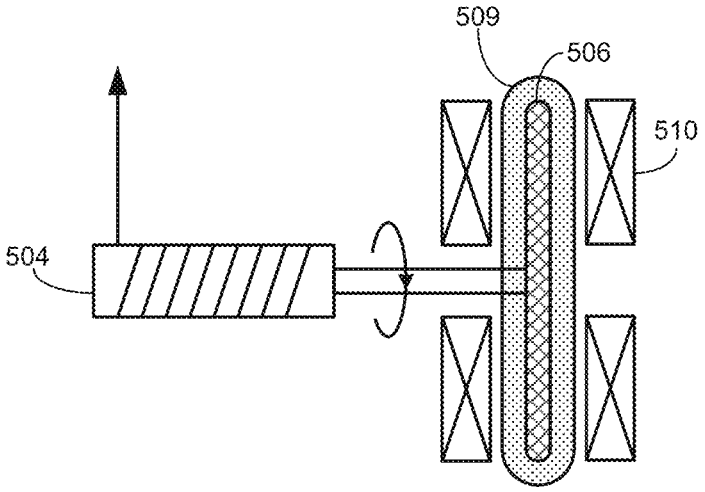
FIG. 5B illustrates a side view of an electro-magnetic braking system for varying load, in accordance with an embodiment of the present invention.

FIG. 5B illustrates a side view of an electro-magnetic braking system for varying load, in accordance with an embodiment of the present invention. In this example, the braking system is based on magnetic particles housed in a cavity 509. A number of coils, such as coil 510, can be used to generate a magnetic flux, which can cause the particles to bind and become viscous. As a result, the resistance against the rotating motion of rotor 506 can be varied. In one embodiment, the load-varying control signal is used to control the current fed into the coils, which in turn can control the torque resistance applied to rotor 506.

Figure 6:
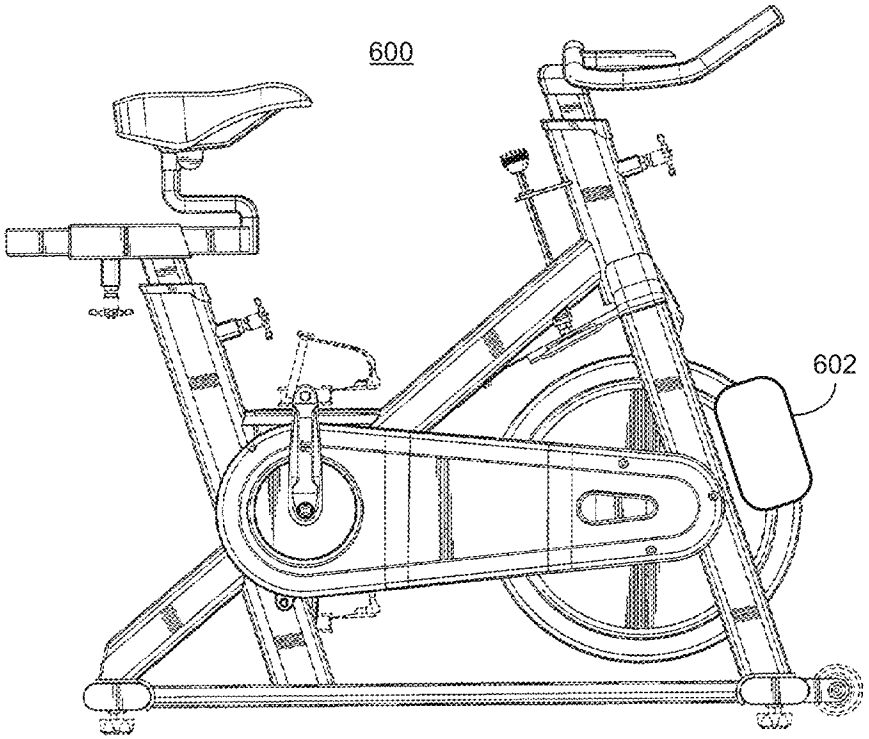
FIG. 6 illustrates an exemplary spinning bike that facilitates a varying load, in accordance with an embodiment of the present invention.

The exemplary system shown in FIGS. 5A and 5B uses an electro-magnetic braking system to apply resistance when a user pulls on cable 502. However, when the user does not apply any force to cable 502, the load is not present. Embodiments of the present invention are not limited to such a configuration. Embodiments of the present invention can be built into various types of exercise machines. FIG. 6 illustrates an exemplary spinning bike that facilitates a varying load, in accordance with an embodiment of the present invention. In this example, a spinning bike 600 can include an electro-magnetic braking mechanism 602, which can be installed to the bike's fly wheel. Electro-magnetic braking mechanism 602 can be based on any type of electro-magnetic brakes, and its braking force can be adjusted by the load-varying control signal. Hence, when a user rides the spinning bike, the resistance of the bike can be varied by electro-magnetic braking mechanism 602.

Figure 7A:
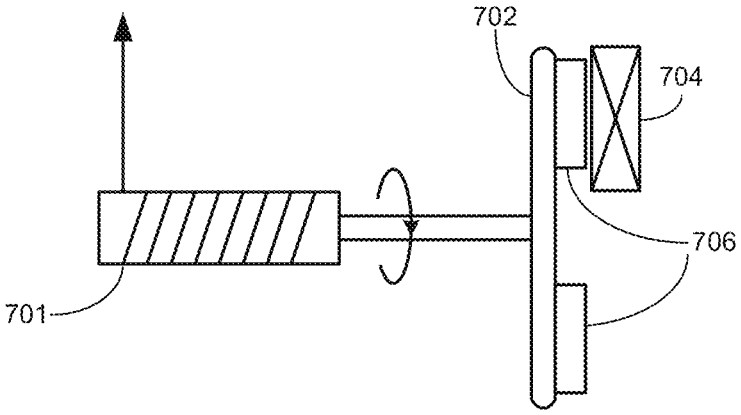
FIG. 7A illustrates a load-varying system using a mechanical braking mechanism, in accordance with an embodiment of the present invention.

Although the examples described above are based on electro-magnetic braking mechanisms, it is also possible to construct a load-varying exercise system using mechanical braking mechanisms. FIG. 7A illustrates a load-varying system using a mechanical braking mechanism, in accordance with an embodiment of the present invention. In this example, a shaft 701 is coupled to a conductive rotor plate 702. A cable wound around shaft 701 can be pulled by a user, which causes rotor plate 702 to rotate. Rotor plate 702 is positioned near a fixed magnet 704. In addition, a number of adjustable conductive discs 706 can be positioned on rotor plate 702, along its rim. The height of each adjustable disc can be adjusted, which in turn determines the distance between each adjustable disc and fixed magnet 704. During operation, when magnet 704 moves across the surface of a respective conductive disc, the change in magnetic field induces an Eddy current in plate 702, which in turn produces a magnetic field that opposes the field from magnet 704, thereby creating a force that opposes the motion of plate 702. Generally, the closer a disc is to magnet 704, the greater the magnet force exists between the disc and magnet 704, and the greater the resistance there is against the rotation of rotor plate 702. In order to create a load variation using the induced Eddy current, it is desirable to have abrupt changes in distance between magnet 704 and discs 706, as well as plate 702. In one embodiment, a respective disc can have a threaded end, which allows the disc to be turned and its top surface moved closer to or farther away from magnet 704.

Figure 7B:
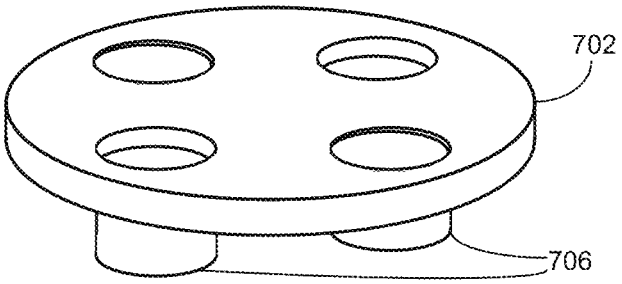
FIG. 7B illustrates an exemplary arrangement of adjustable discs on a rotor plate of a mechanical braking mechanism, in accordance with one embodiment of the present invention.

FIG. 7B illustrates an exemplary arrangement of adjustable discs on a rotor plate of a mechanical braking mechanism, in accordance with one embodiment of the present invention. In this example, 4 adjustable discs 706 are placed along the rim of rotor plate 702. Each adjustable disc provides an opportunity to change the resistance force applied to rotor plate 702.

Figure 7C:
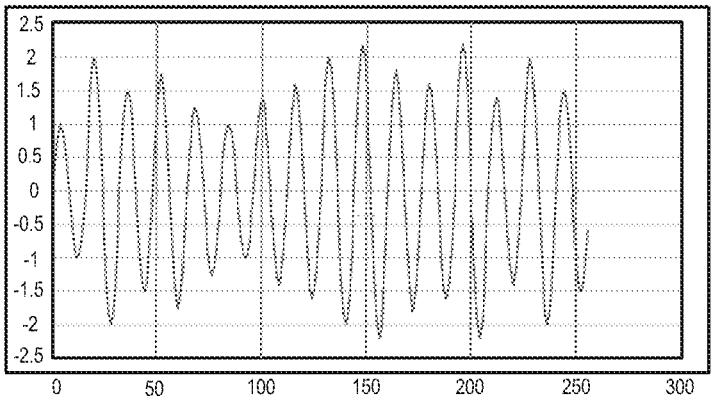
FIG. 7C illustrates an exemplary force applied to the load-varying system corresponding to a magnet passing a disc, in accordance with one embodiment of the present invention.

As the magnet passed over a disc with a change in height, there would be a reduction in the drag. The concept illustrated in FIGS. 7A and 7B can produce a variable load on the system. Note that there will be both a positive and negative force for a magnet passing a disc. FIG. 7C illustrates an exemplary force applied to the load-varying system corresponding to a magnet passing a disc, in accordance with one embodiment of the present invention. In this example, each cycle corresponds to a magnet passing a disc. The positive and negative portions of the waveform correspond to positive and negative drag applied to the system, respectively. In actuality, the graph might be shifted in the positive direction some amount a practical mechanism would have friction and likely a return mechanism that can apply a resisting force. Another important factor is that the inertia of any flywheel can absorb some of the force changes resulting from magnets or any other method of load variation. Hence, it is desirable for a rotor plate to have an inertia that is small in its relative energy storage capacity compared with the energy produced by the load-varying element.

The methods and systems described herein can also be integrated into hardware modules or apparatus. These modules or apparatus may include, but are not limited to, an application-specific integrated circuit (ASIC) chip, a field-programmable gate array (FPGA), a system on a chip (SoC), and/or other circuit devices now known or later developed. When the hardware modules or apparatus are activated, they perform the circuit functions included within them.

The foregoing descriptions of various embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention.

What is claimed is:

1. A system that facilitates load-variation in an exercise machine, the system comprising:

a processor;

a storage device storing instructions that when executed by the processor cause the processor to:

generate a load-control pattern according to a load-varying program; and configure a digital pulse width modulation (PWM) circuit based on the load-control pattern to output a load-control pulse train to a braking mechanism of the exercise machine;

wherein the load-control pulse train causes the braking mechanism of the exercise machine to change an amplitude and a frequency of a time-varying amount of load to be added to a base load of the exercise machine, thereby simulating an effect of applying a mechanical vibration during exercise for effective muscle stimulation, wherein the amplitude of the time-varying amount of load is determined by values of duty cycles of the load-control pulse train, and wherein the frequency of the time-varying amount of load is determined by a rate of variation of the values of the duty cycles of the load-control pulse train;

wherein the load-control pattern indicates an amplitude range and a frequency range for the time-varying amount of load; and wherein a frequency of the load-control pulse train is high relative to the frequency of the time-varying amount of load such that a user does not perceive modulation of pulses in the load-control pulse train.

2. The system of claim 1, wherein the braking mechanism comprises an electrical generator coupled to a circuit.

3. The system of claim 2, wherein the load-control pulse train is configured to vary a resistive load of the circuit.

4. The system of claim 1, wherein the braking mechanism comprises an electro-magnetic brake.

5. The system of claim 4, wherein the exercise machine further comprises a rotor; and wherein the electro-magnetic brake is configured to apply a braking force on the rotor.

6. The system of claim 1, wherein the load-control pattern further indicates at least one of:

a period duration for the time-varying amount of load;

a number of periods for the time-varying amount of load; and a randomized time-varying amount of load.

7. The system of claim 1, wherein the instructions further cause the processor to receive a user input to select a pre-configured load-varying program or to define a custom load-varying program.

8. The system of claim 1, wherein the braking mechanism comprises a mechanical brake.

9. A method for facilitating load-variation in an exercise machine, the method comprising:

generating a load-control pattern according to a load-varying program;

configuring a digital pulse width modulation (PWM) circuit based on the load-control pattern to output a load-control pulse train; and outputting the load-control pulse train to a braking mechanism of the exercise machine to change an amplitude and a frequency of a time-varying amount of load to be added to a base load of the exercise machine, thereby simulating an effect of applying a mechanical vibration during exercise for effective muscle stimulation, wherein the amplitude of the time-varying amount of load is determined by values of duty cycles of the load-control pulse train, wherein the frequency of the time-varying amount of load is determined by a rate of variation of the values of the duty cycles of the load-control pulse train, wherein the load-control pattern indicates an amplitude range and a frequency range for the time-varying amount of load; and wherein a frequency of the load-control pulse train is high relative to the frequency of the time-varying amount of load such that a user does not perceive modulation of pulses in the load-control pulse train.

10. The method of claim 9, wherein the braking mechanism comprises an electrical generator coupled to a circuit.

11. The method of claim 10, further comprising varying a resistive load of the circuit using the load-control pulse train.

12. The method of claim 9, wherein the braking mechanism comprises an electro-magnetic brake.

13. The method of claim 12, wherein the exercise machine further comprises a rotor; and wherein adding the time-varying amount of load comprises applying a braking force, by the electro-magnetic brake, on the rotor.

14. The method of claim 9, wherein the load-control pattern further indicates at least one of:

a period duration for the time-varying amount of load;

a number of periods for time-varying amount of load; and a randomized time-varying amount of load.

15. The method of claim 9, further comprising receiving a user input to select a pre-configured load-varying program or to define a custom load-varying program.

16. The method of claim 9, wherein the braking mechanism comprises a mechanical brake.

17. An exercise machine that facilitates a varying load, the machine comprising:

a control unit configured to produce a load-control pattern according to a load-varying program;

a digital pulse width modulation (PWM) circuit configured to output a load-control pulse train based on the load-control pattern; and a braking mechanism configured to change an amplitude and a frequency of a time-varying amount of load to be added to a base load of the exercise machine based on the load-control pulse train, thereby simulating an effect of applying a mechanical vibration during exercise for effective muscle stimulation, wherein the amplitude of the time-varying amount of load is determined by values of duty cycles of the load-control pulse train, wherein the frequency of the time-varying amount of load is determined by a rate of variation of the values of the duty cycles of the load-control pulse train, wherein the load-control pattern indicates an amplitude range and a frequency range for the time-varying amount of load, and wherein a frequency of the load-control pulse train is high relative to the frequency of the time-varying amount of load such that a user does not perceive modulation of pulses in the load-control pulse train.

* * * * *